US010064264B2

(12) United States Patent
Abs et al.

(10) Patent No.: US 10,064,264 B2
(45) Date of Patent: Aug. 28, 2018

(54) POLE INSERT FOR CYCLOTRON

(71) Applicant: Ion Beam Applications, S.A., Louvain-la-Neuve (BE)

(72) Inventors: Michel Abs, Bossière (BE); Szymon Zaremba, Belgrade (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 15/594,525

(22) Filed: May 12, 2017

(65) Prior Publication Data

US 2017/0332473 A1 Nov. 16, 2017

(30) Foreign Application Priority Data

May 13, 2016 (EP) ..... 16169489
May 13, 2016 (EP) ..... 16169490
(Continued)

(51) Int. Cl.
*H01F 7/02* (2006.01)
*H05H 7/10* (2006.01)
(Continued)

(52) U.S. Cl.
CPC ..... *H05H 7/10* (2013.01); *H01F 3/10* (2013.01); *H01F 7/02* (2013.01); *H01F 7/20* (2013.01);
(Continued)

(58) Field of Classification Search
CPC ..... H01F 1/00; H01F 3/00; H01F 7/00; H01F 7/02; H02K 7/04; H02K 7/14
(Continued)

(56) References Cited

U.S. PATENT DOCUMENTS 4,149,731 A * 4/1979 Yoshida ..... G01M 3/022 277/624
4,555,685 A * 11/1985 Maruyama ..... H01F 7/021 310/168
(Continued)

FOREIGN PATENT DOCUMENTS

GB 1 485 329 A 9/1977
JP H11 238599 A 8/1999
(Continued)

OTHER PUBLICATIONS

European Search Report dated Nov. 2, 2016, 4 pages.

*Primary Examiner* — Shawki S Ismail
*Assistant Examiner* — Lisa Homza
(74) *Attorney, Agent, or Firm* — Finnegan, Henderson, Farabow, Garrett & Dunner LLP

(57) ABSTRACT

The present disclosure relates to a magnet pole for an isochronous sector-focused cyclotron having hill and valley sectors alternatively distributed around a central axis, Z, each hill sector having an upper surface bounded by four edges: an upper peripheral edge, an upper central edge, a first and a second upper lateral edges. The upper surface of at least one hill sector may further include: a recess extending over a length between a proximal end and a distal end along a longitudinal axis intersecting the upper peripheral edge and the upper central edge. The recess may be separate from the first and second upper lateral edges over at least 80% of its length, and a pole insert having a geometry fitting in the recess may be positioned in, and reversibly coupled to the recess.

19 Claims, 7 Drawing Sheets

(30) Foreign Application Priority Data

May 13, 2016 (EP) ..... 16169494
May 13, 2016 (EP) ..... 16169497

(51) Int. Cl.

| | |
|---|---|
| ***H05H 7/04*** | (2006.01) |
| ***H05H 13/00*** | (2006.01) |
| ***H05H 7/00*** | (2006.01) |
| ***H05H 13/08*** | (2006.01) |
| ***H01F 3/10*** | (2006.01) |
| ***H01F 7/20*** | (2006.01) |

(52) U.S. Cl.
CPC ..... *H05H 7/001* (2013.01); *H05H 7/04* (2013.01); *H05H 13/005* (2013.01); *H05H 13/08* (2013.01); *H05H 2007/002* (2013.01); *H05H 2007/043* (2013.01)

(58) Field of Classification Search
USPC ..... 335/302
See application file for complete search history.

(56) References Cited

U.S. PATENT DOCUMENTS 7,199,689 B1 * 4/2007 Abele ..... G01R 33/383 324/319
8,373,528 B2 * 2/2013 Takayama ..... A61B 1/00158 335/284
2005/0139180 A1 * 6/2005 Isobe ..... F16K 31/0613 123/90.17
2006/0162682 A1 * 7/2006 Kondo ..... F01L 1/3442 123/90.17
2006/0279391 A1 * 12/2006 Xia ..... G01R 33/3802 335/306
2007/0024405 A1 * 2/2007 Terasaki ..... H01F 7/021 335/302
2007/0261592 A1 * 11/2007 Mochida ..... B61D 15/06 105/392.5
2008/0236965 A1 * 10/2008 Nakamura ..... B61D 15/06 188/268
2010/0047999 A1 * 2/2010 Hoshino ..... H01L 21/67092 438/463
2012/0301234 A1 * 11/2012 Yamaguchi ..... B23B 51/048 407/100
2013/0025903 A1 * 1/2013 Yamaguchi ..... B26B 19/3853 174/50
2013/0129430 A1 * 5/2013 Bhagath ..... B23B 27/007 407/33
2014/0254989 A1 * 9/2014 Takahashi ..... G02B 6/3861 385/80
2017/0201153 A1 * 7/2017 Yamanaka ..... H02K 7/04

FOREIGN PATENT DOCUMENTS

RU 2 373 673 C1 11/2009
WO WO 2012/004225 A1 1/2012

* cited by examiner

POLE INSERT FOR CYCLOTRON

This application claims the benefit of priority of European Patent Application No. 16169489.8, filed on May 13, 2016, European Patent Application No. 16169490.6, filed on May 13, 2016, European Patent Application No. 16169494.8, filed on May 13, 2016, and European Patent Application No. 16169497.1, filed on May 13, 2016, all of which are incorporated herein by reference.

TECHNICAL FIELD

The present disclosure relates to cyclotrons. In particular, it relates to isochronous sector-focused cyclotrons having enhanced fine tuning control of the magnetic field generated between two opposite hill sectors of two magnet poles.

TECHNICAL BACKGROUND

A cyclotron is a type of circular particle accelerator in which negatively or positively charged particles are accelerated outwards from the centre of the cyclotron along a spiral path up to energies of several MeV. Unless otherwise indicated, the term "cyclotron" is used in the following to refer to isochronous cyclotrons. Cyclotrons are used in various fields, for example in nuclear physics, in medical treatment such as proton-therapy, or in radio-pharmacy. In particular, cyclotrons can be used for producing short-lived positron-emitting isotopes suitable for PET imaging (positron emitting tomography) or for producing gamma-emitting isotopes, for example, Tc99m, for SPECT imaging (single photon emission computed tomography).

A cyclotron generally comprises several elements including an injection system, a radiofrequency (RF) accelerating system for accelerating the charged particles, a magnetic system for guiding the accelerated particles along a precise path, an extraction system for collecting the thus accelerated particles, and a vacuum system for creating and maintaining a vacuum in the cyclotron.

A particle beam constituted of charged ions is introduced into a gap at or near the center of the cyclotron by the injection system with a relatively low initial velocity. As illustrated in FIG. 3, this particle beam is sequentially and repetitively accelerated by the RF accelerating system and guided outwards along a spiral path comprised within the gap by the magnetic field generated by the magnetic system. When the particle beam reaches its target energy, it can be extracted from the cyclotron by the extraction system provided at a point of extraction, PE. This extraction system can comprise, for example, a stripper consisting of a thin sheet of graphite. For example, $H^-$ ions passing through the stripper lose two electrons and become positive. Consequently, the curvature of their path in the magnetic field changes its sign, and the particle beam is thus led out of the cyclotron towards a target. Other extracting systems exist which are well known to the persons skilled in the art.

The magnetic system generates a magnetic field that guides and focuses the beam of charged particles along the spiral path until it is accelerated to its target energy. In the following, the terms "particles", "charged particles", and "ions" are used indifferently as synonyms. The magnetic field is generated in the gap defined between two magnet poles by two solenoid coils, 14, wound around these poles. Magnet poles of cyclotrons are often divided into alternating hill sectors and valley sectors distributed around a central axis. The gap between two magnet poles is smaller at the hill sectors and the larger at the valley sectors. A strong magnetic field is thus created in the hill gap portions within the hill sectors and a weaker magnetic field is created in the valley gap portions within the valley sectors. Such azimuthal magnetic field variations provide radial and vertical focusing of the particle beam every time the particle beam reaches a hill gap portion. For this reason, such cyclotrons are sometimes referred to as sector-focusing cyclotrons. In some embodiments, a hill sector has a geometry of a circular sector similar to a slice of cake with a first and second lateral surfaces extending substantially radially towards the central axis, a generally curved peripheral surface, a central surface adjacent to the central axis, and an upper surface defining one side of a hill gap portion. The upper surface is delimited by a first and second lateral edges, a peripheral edge, and a central edge.

It is difficult to manufacture a pair of magnet poles yielding a perfectly predictable magnetic field due, inter alia, to defects and or inhomogeneities in the steel used for the magnet poles, machining precision, as well as to differences between different batches of steel. For this reason, one lateral edge of a hill sector is often cut off to accommodate a lateral pole insert. Upon the results of calibration tests, said lateral pole insert is removed, machined to modify the topography of the upper surface and/or of the lateral surface thereof, and repositioned onto the hill sector. This operation allows the correction of the actual magnetic field and is repeated until it matches the target magnetic field. These iterative corrections including the removal, machining, and repositioning of a lateral pole insert can be long and cumbersome. This is particularly true because the same operations must be carried out identically on the lateral pole inserts of all the hill sectors.

There therefore remains a need in the art to provide an isochronous sector-focused cyclotron allowing an easy and cost effective fine tuning of the magnetic field formed at the hill gap portions between hill sectors to match the target properties thereof.

SUMMARY

Embodiments of the present disclosure are defined in the appended independent claims. Further embodiments are defined in the dependent claims.

Embodiments of the present disclosure relate to a magnet pole for a cyclotron comprising at least 3 hill sectors and a same number of valley sectors alternatively distributed around a central axis, Z, each hill sector comprising: an upper surface defined by:

- an upper peripheral edge, said upper peripheral edge being bounded by a first and a second upper distal ends, and being defined as the edge of the upper surface located furthest from the central axis;
- an upper central edge, said upper central edge being bounded by a first and a second upper proximal ends and being defined as the edge of the upper surface located closest from the central axis;
- a first upper lateral edge connecting the first upper distal end and first upper proximal end;
- a second upper lateral edge connecting the second upper distal end and second upper proximal end;

characterized in that the upper surface of at least one hill sector further comprises:

- a recess extending over a length between a proximal end and a distal end along a longitudinal axis intersecting the upper peripheral edge and the upper central edge; said recess being separate from the first and second upper lateral edges over at least 80% of its length, and a pole insert having a geometry fitting in said recess and being positioned in, and reversibly coupled to said recess.

The recess may extend to the upper central edge and/or to the upper peripheral edge.

The shape of the pole insert is important. The pole insert may comprise a portion having a prismatic or parallelepiped geometry.

In order to facilitate insertion of the pole insert in the recess, the cross section normal to the longitudinal axis of the prismatic portion of the pole insert may be trapezoidal with lateral surfaces converging from the upper surface.

For manufacturing reasons, the pole insert may have a proximal portion converging towards the central axis, said proximal portion comprising the whole upper central edge and being flushed with the first and second lateral edges.

The pole insert may have a length measured parallel to the longitudinal axis and a width measured normal to said longitudinal axis, and comprise an insert upper and a first and second lateral surfaces, at least one surface being structured with a succession of recesses and protrusions. These structures may allow correcting the magnetic field to obtain the target properties predicted numerically.

These recesses and protrusions may be grooves and/or holes, said grooves being either transverse, or parallel to the longitudinal axis and extending along a straight, curved or broken line, said holes being blind holes or through holes.

The recesses and protrusions may extend normal to the longitudinal axis over the whole width of the pole insert.

The hill sector of a magnet pole has a height, Hh, measured parallel to the central axis, Z, between the upper surface and the valley sector, and wherein the pole insert has a height measured parallel to the central axis, Z, and comprised between 20% and 80% of the height of a hill sector, Hh, for example, between 30% and 70% or between 40% and 60% of the height of a hill sector.

The hill sector has an azimuthal length, Ah, measured between the first and a second upper distal ends, and wherein the width of the pole insert is not more than 15%, for example, not more than 10% or not more than 5% of the azimuthal length of the hill sector.

Each valley sector may comprise a bottom surface, and each hill sector may comprise first and second lateral surfaces, defined as surfaces extending transversally from the first and second upper lateral edges, to the bottom surfaces of the corresponding valley sectors located on either sides of a hill sector, and forming a chamfer at the first and second lateral edges, respectively.

In some embodiments, the first and second lateral edges of a hill sector of a magnet pole are straight lines.

To increase symmetry, the longitudinal axis may intersect the upper peripheral edge at a point of the upper peripheral edge located at equal distance+/−10% from the first and second upper distal ends, for example, at equal distance.

Embodiments of the present disclosure also relate to a cyclotron comprising first and second magnet poles such as described above, wherein the first and second magnet poles are positioned with their respective upper surfaces facing each other and symmetrically with respect to a median plane normal to the central axes of the first and second magnet poles, said central axes being coaxial.

SHORT DESCRIPTION OF THE DRAWINGS

These and further aspects of the present disclosure will be explained in greater detail by way of example and with reference to the accompanying drawings in which:

FIG. 1 schematically shows (a) a side cut view and (b) a top view of a cyclotron according to example embodiments of the present disclosure.

DETAILED DESCRIPTION

Geometry of a Cyclotron

Figure 3:
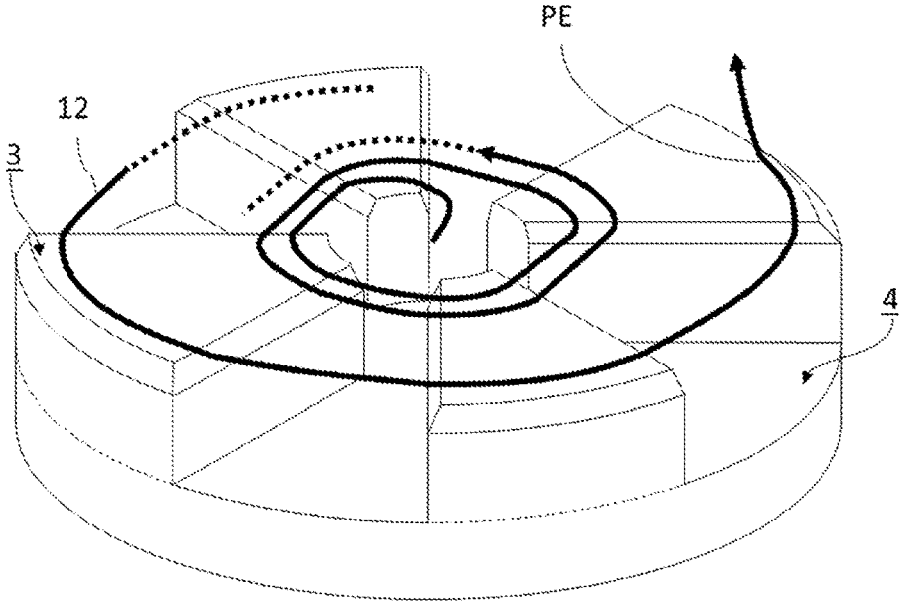
FIG. 3 shows a partial perspective view of a half cyclotron and the path of accelerates charged particles (the outlets for the extracted particles in the flux return yokes are not shown for enhancing visibility).

The present disclosure relates to isochronous sector-focused cyclotrons, hereafter referred to as cyclotron of the type discussed in the technical background section supra. As illustrated in FIG. 3, a cyclotron according to embodiments of the present disclosure accelerates charged particles outwards from a central area of the cyclotron along a spiral path 12 until they are extracted at energies of several MeV. For example, the charged particles thus extracted can be protons, $H^+$, or deuteron, D. In certain aspects, the energy reached by the extracted particles is comprised between 5 and 30 MeV, for example, between 15 and 21 MeV or, by way of further example, 18 MeV. Cyclotrons of such energies are used, for example, for producing short-lived positron-emitting isotopes suitable for use in PET imaging (positron emitting tomography) or for producing gamma-emitting isotopes, for example, Tc99m, for SPECT imaging (single photon emission computed tomography).

Figure 1:
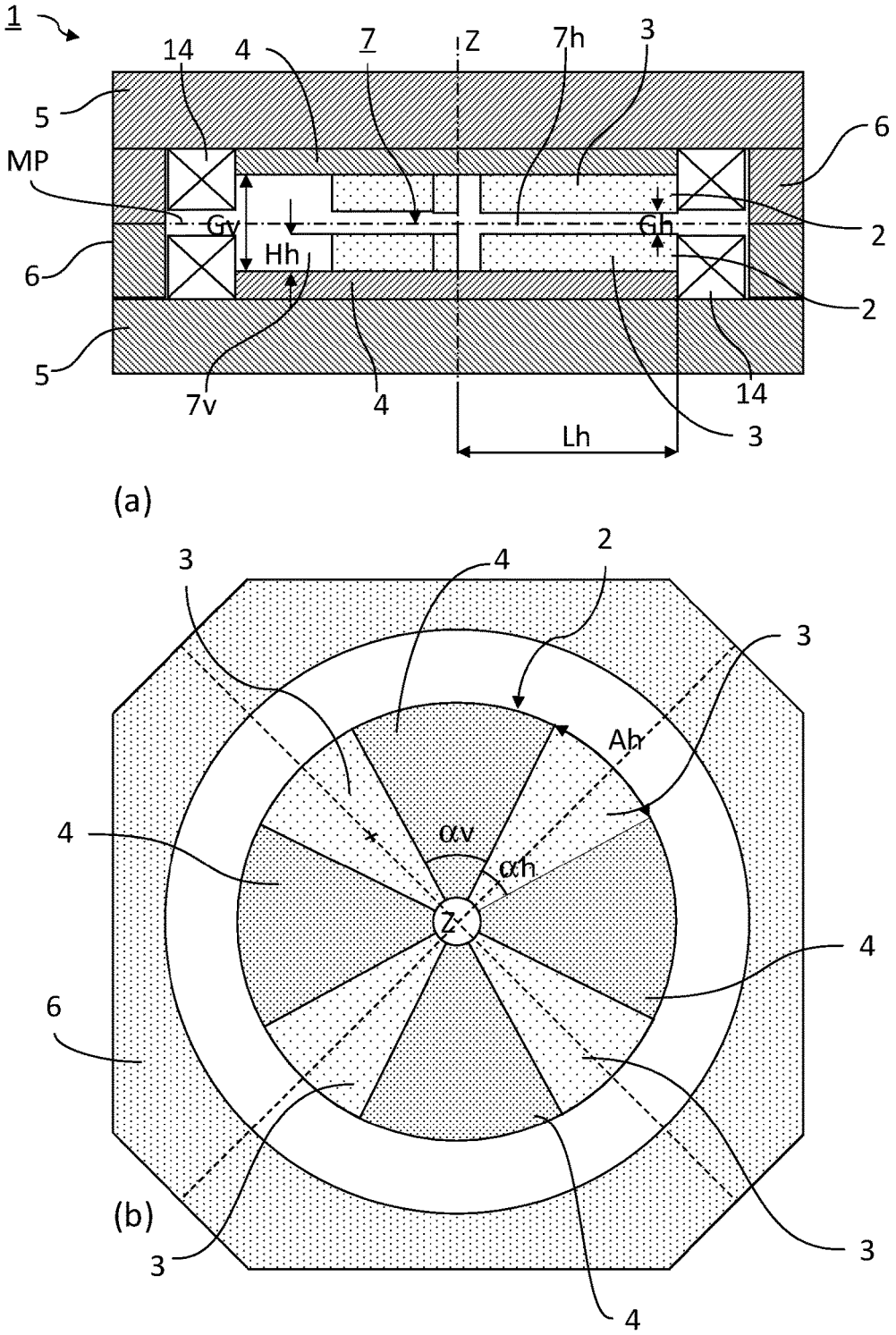

As illustrated in FIG. 1 a cyclotron 1 according to an embodiment of the present disclosure comprises two base plates 5 and flux return yokes 6 which, together, form a yoke. The flux return yokes form the outer walls of the cyclotron and control the magnetic field outside of the coils 14 by containing it within the cyclotron. It further comprises first and second magnet poles 2 located in a vacuum chamber, facing each other symmetrically with respect to a median plane MP normal to a central axis, Z, and separated from one another by a gap 7. The yoke and the magnet poles are all made of a magnetic material, for example, a low carbon steel and form a part of the magnetic system. The magnetic system is completed by a first and second coils 14 made of electrically conductive wires wounded around the first and second magnet poles and fitting within an annular space defined between the magnet poles and the flux return yokes.

Figure 2:
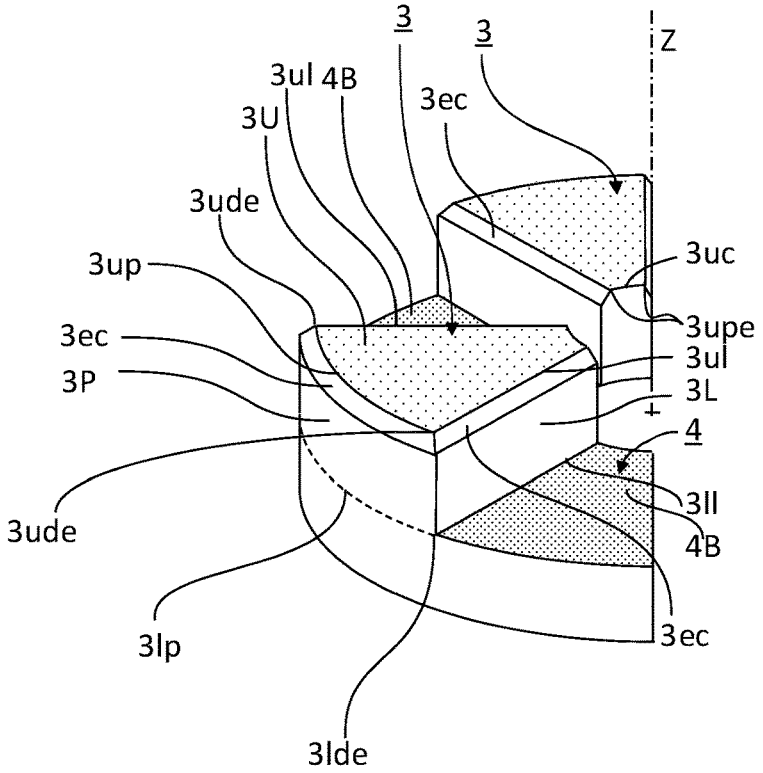
FIG. 2 shows an example of hill and valley sectors of a cyclotron according to example embodiments of the present disclosure.

As illustrated in FIG. 1(*b*) and FIG. 2, each of the first and second magnet poles 2 comprises at least N=3 hill sectors 3 distributed radially around the central axis, Z (FIG. 1(*b*) illustrates one embodiment with N=4). Each hill sector 3, represented in FIG. 1(*b*) as light shaded areas, has an upper surface 3U extending over a hill azimuthal angle, αh. Each of the first and second magnet poles 2 further comprises the same number, N, of valley sectors 4, represented in FIG. 1(*b*) as dark shaded areas, distributed radially around the central axis Z. Each valley sector 4 is flanked by two hill sectors 3 and has a bottom surface 4B extending over a valley azimuthal angle, αv, such that αh+αv=360°/N.

The hill sectors 3 and valley sectors 4 of the first magnet pole 2 face the opposite hill sectors 3 and valley sectors 4, respectively, of the second magnet pole 2. The path 12 followed by the particle beam illustrated in FIG. 3 is comprised within the gap 7 separating the first and second magnet poles. The gap 7 between the first and second magnet poles thus comprises hill gap portions 7*h* defined between the upper surfaces 3U of two opposite hill sectors 3 and valley gap portions 7*v* defined between the bottom surfaces 4B of two opposite valley sectors 4. The hill gap portions 7*h* have an average gap height, Gh, defined as the average height of the hill gap portions over the areas of two opposite upper surfaces 3U.

Average hill and valley gap heights are measured as the average of the gap heights over the whole upper surface and lower surface of a hill sector and a valley sector, respectively. The average of the valley gap height ignores any opening on the bottom surfaces.

The upper surface 3U is defined by (see FIG. 2):

- an upper peripheral edge 3*up*, said upper peripheral edge being bounded by a first and a second upper distal ends 3*ude*, and being defined as the edge of the upper surface located furthest from the central axis Z;
- an upper central edge 3*uc*, said upper central edge being bounded by a first and a second upper proximal ends 3*upe* and being defined as the edge of the upper surface located closest from the central axis;
- a first upper lateral edge 3*ul* connecting the first upper distal end and first upper proximal end;
- a second upper lateral edge 3*ul* connecting the second upper distal end and second upper proximal end.

A hill sector 3 further comprises (see FIG. 2):

- a first and second lateral surfaces 3L each extending transversally from the first and second upper lateral edges, to the bottom surfaces of the corresponding valley sectors located on either sides of a hill sector, thus defining a first and second lower lateral edges 3*ll* as the edges intersecting a lateral surface with an adjacent bottom surface, said first and second lower lateral edges each having a lower distal end 3*lde* located furthest from the central axis;
- a peripheral surface 3P extending from the upper peripheral edge to a lower peripheral line 3*lp* defined as the segment bounded by the lower distal ends 3*lde* of the first and second lower lateral edges.

The average height of a hill, Hh, sector is the average distance measured parallel to the central axis between lower and upper lateral edges.

An end of an edge is defined as one of the two extremities bounding a segment defining the edge. A proximal end is the end of an edge located closest from the central axis, Z. A distal end is the end of an edge located furthest from the central axis, Z. An end can be a corner point which is defined as a point where two or more lines meet. A corner point can also be defined as a point where the tangent of a curve changes sign or presents a discontinuity.

An edge is a line segment where two surfaces meet. An edge is bounded by two ends, as defined supra, and defines one side of each of the two meeting surfaces. For reasons of machining tools limitations, as well as for reduction of stress concentrations, two surfaces often meet with a given radius of curvature, R, which makes it difficult to define precisely the geometrical position of the edge intersecting both surfaces. In this case, the edge is defined as the geometric line intersecting the two surfaces extrapolated so as to intersect each other with and infinite curvature (1/R). An upper edge is an edge intersecting the upper surface 3U of a hill sector, and a lower edge is an edge intersecting the bottom surface 4B of a valley sector.

A peripheral edge is defined as the edge of a surface comprising the point located the furthest from the central axis, Z. If the furthest point is a corner point shared by two edges, the peripheral edge is also the edge of a surface which average distance to the central axis, Z, is the largest. For example, the upper peripheral edge is the edge of the upper surface comprising the point located the furthest to the central axis. If a hill sector is compared to a slice of tart, the peripheral edge would be the peripheral crust of the tart.

In an analogous manner, a central edge is defined as the edge of a surface comprising the point located the closest to the central axis, Z. For example, the upper central edge is the edge of the upper surface comprising the point located the closest to the central axis, Z.

A lateral edge is defined as the edge joining a central edge at a proximal end to a peripheral edge at a distal end. The proximal end of a lateral edge is therefore the end of said lateral edge intersecting a central edge, and the distal end of said lateral edge is the end of said lateral edge intersecting a peripheral edge.

Depending on the design of the cyclotron, the upper/lower central edge may have different geometries. The most common geometry is a concave line (or concave curve), often circular, of finite length (≠0), with respect to the central axis, which is bounded by a first and second upper/lower proximal ends, separated from one another. This configuration is useful as it clears space for the introduction into the gap of the particle beam and other elements. In a first alternative configuration, the first and second proximal central ends are merged into a single proximal central point, forming a summit of the upper surface 3U, which comprises three edges only, the central edge having a zero-length. If a hill sector is again compared to a slice of tart, the pointed tip of the slice would correspond to the central edge thus reduced to a single point. In a second alternative configuration, the transition from the first to the second lateral edges can be a curve convex with respect to the central axis, Z, leading to a smooth transition devoid of any corner point. In this configuration, the central edge is also reduced to a single point defined as the point wherein the tangent changes sign. Usually, even in the first and second alternative configurations, a hill sector does not extend all the way to the central axis, the central area directly surrounding the central axis is cleared to allow insertion of the particle beam or installation of other elements.

As shown is FIG. 2, the first and second lateral surfaces 3L may be chamfered forming a chamfer 3*ec* at the first and second upper lateral edges, respectively. A chamfer is defined as an intermediate surface between two surfaces obtained by cutting off the edge which would have been formed by the two surfaces absent a chamfer A chamfer reduces the angle formed at an edge between two surfaces. Chamfers are often used in mechanics for reducing stress concentrations. In cyclotrons, however, a chamfered lateral surface at the level of the upper surface of a hill sector enhances the focusing of the particle beam as it reaches a hill gap portion 7*h*. The peripheral surface 3P of a hill sector can also form a chamfer at the upper peripheral edge, which improves the homogeneity of the magnetic field near the peripheral edge.

A cyclotron according to an embodiment of the present disclosure may comprise N=3 to 8 hill sectors 3. For example, as illustrated in the Figures, N=4. For even values of N, the hill sectors 3 and valley sectors 4 must be distributed about the central axis with any symmetry of 2*n*, with n=1 to N/2. For example, according to a certain aspect, n=N/2, such that all the N hill sectors are identical to one another, and all the N valley sectors are identical to one another. For odd values of N, the hill sectors 3 and valley sectors 4 must be distributed about the central axis with a symmetry of N. For example, according to a certain aspect, the N hill sectors 3 are uniformly distributed around the central axis for all N=3-8 (i.e., with a symmetry of N). The first and second magnet poles 2 are positioned with their respective upper surfaces 3U facing each other and symmetrically with respect to the median plane MP normal to the respective central axes Z of the first and second magnet poles 2, which are coaxial.

The shape of the hill sectors is often wedge shaped like a slice of tart (often, as discussed supra, with a missing tip) with the first and second lateral surfaces 3L converging from the peripheral surface towards the central axis Z (usually without reaching it). The hill azimuthal angle, αh, corresponds to the converging angle, measured at the level of the intersection point of the (extrapolated) upper lateral edges of the lateral surfaces at, or adjacent to, the central axis Z. The hill azimuthal angle, αh, may be between 360°/2N±10°, for example, between 360°/2N±5° or between 360°/2N 2°.

The valley azimuthal angle αv, measured at the level of the central axis Z may be between 360°/2N±10°, for example, between 360°/2N±5° or between 360°/2N±2°. The valley azimuthal angle αv may be equal to the hill azimuthal angle, ah. In case of a degree of symmetry of N, αv=360°/N−αh; for example, for N=4, αv is the complementary angle of ah, with αv=90°−αh.

The largest distance, Lh, between the central axis and a peripheral edge may be between 200 and 2000 mm, for example, between 400 and 1000 mm or between 500 and 800 mm. For a 18 MeV proton cyclotron, the longest distance, Lh, is usually less than 750 mm, and may be of the order of 500 to 750 mm, typically 520 to 550 mm. The upper peripheral edge has an azimuthal length, Ah, measured between the first and second upper peripheral ends, and can be approximated to, Ah=Lh×αh [rad].

The two magnet poles 2 and solenoid coils 14 wound around each magnet pole form an (electro-)magnet which generates a magnetic field in the gap 7 between the magnetic poles that guides and focuses the beam of charged particles (=particle beam) along a spiral path 12 illustrated in FIG. 3, starting from the central area (around the central axis, Z) of the cyclotron, until it reaches a target energy, for example of 18 MeV, whence it is extracted. As discussed supra, the magnet poles are divided into alternating hill sectors and valley sectors distributed around the central axis, Z. A strong magnetic field is thus created in the hill gap portions 7*h* of average height Gh within the hill sectors and a weaker magnetic field is created in the valley gap portions 7*v* of average height Gv>Gh, within the valley sectors thus creating vertical focusing of the particle beam.

When a particle beam is introduced into a cyclotron, it is accelerated by an electric field created between high voltage electrodes called dees (not shown), and ground voltage electrodes attached to the lateral edges of the poles, positioned in the valley sectors, where the magnetic field is weaker. Each time an accelerated particle penetrates into a hill gap portion 7*h* it has a higher speed than it had in the preceding hill sector. The high magnetic field present in a hill sector deviates the trajectory of the accelerated particle to follow an essentially circular path of radius larger than it followed in the preceding hill sector. Once a particle beam has been accelerated to its target energy, it is extracted from the cyclotron at a point called point of extraction PE, as shown in FIG. 3. For example, energetic protons, $H^+$, can be extracted by driving a beam of accelerated $H^-$ ions through a stripper consisting of a thin foil sheet of graphite. A ion passing through the stripper loses two electrons to become a positive, H. By changing the sign of particle charge, the curvature of its path in the magnetic field changes sign, and the particle beam is thus led out of the cyclotron towards a target (not shown). Other extracting systems are known by the persons skilled in the art and the type and details of the extraction system used is not essential to some embodiments of the present disclosure. Usually, a point of extraction is located in a hill gap portion 7*h*. A cyclotron can comprise several points of extraction in a same hill portion. Because of the symmetry requirements of a cyclotron, more than one hill sector comprises an extraction point. For degrees of symmetry of N, all N hill sectors comprise the same number of points of extraction. The points of extraction can be used individually (one only at a time) or simultaneously (several at a time).

Pole Insert

Figure 4:
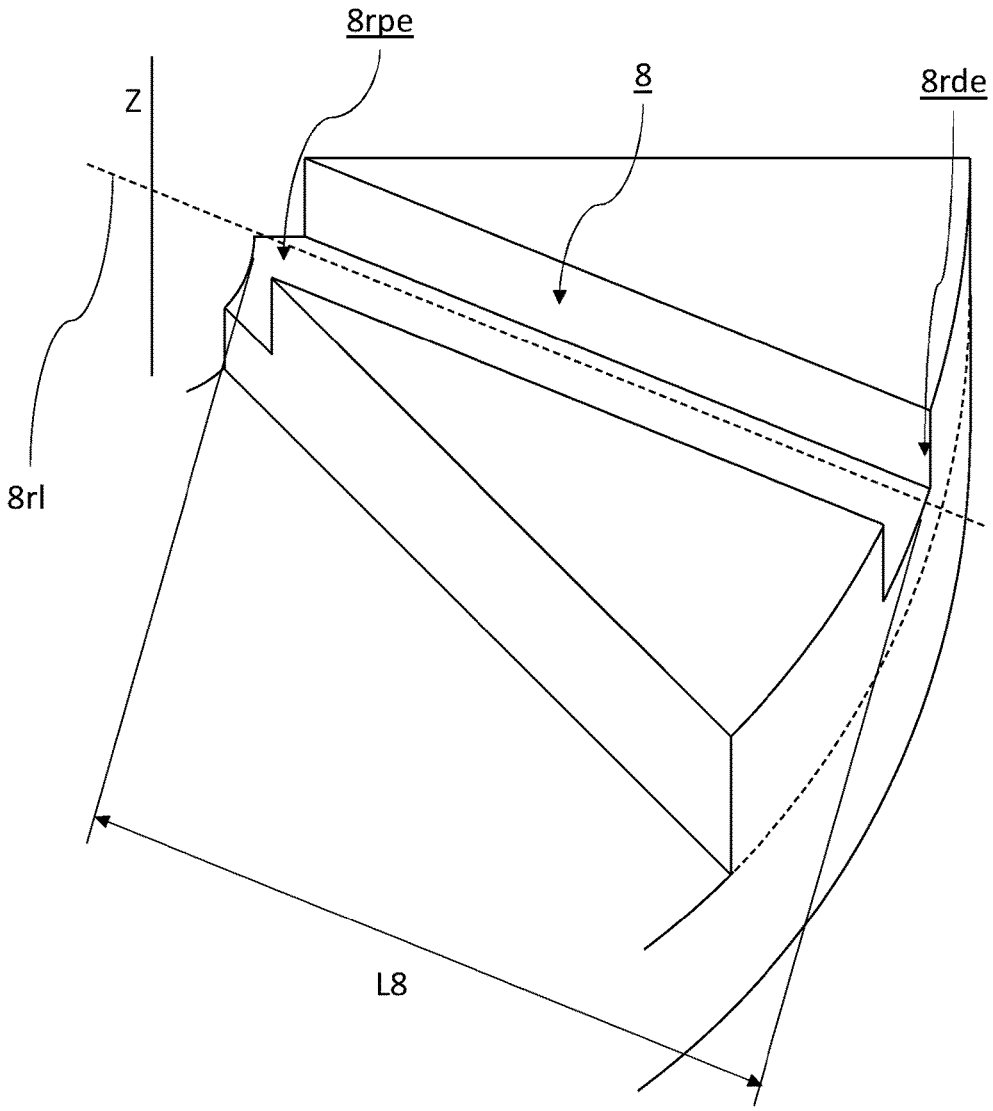
FIG. 4 shows an example of a hill sector according to example embodiments of the present disclosure comprising a recess.

FIGS. 1 and 3 show an example of an embodiment of a magnet pole for a cyclotron comprising N=4 hill sectors and N=4 valley sectors alternatively distributed around a central axis, Z with a symmetry of N=4. FIGS. 2 and 4 show one hill sector of such magnet pole wherein each hill sector 3 comprises an upper surface 3U such as defined above, bounded by an upper peripheral edge 3*up*, an upper central edge 3*uc*, and a first and second upper lateral edges 3*u*1. According to an embodiment of the present disclosure, the upper surface of at least one hill sector further comprises:

- a recess 8 (FIG. 4) extending over a length L8 between a recess proximal end 8*rpe* and a recess distal end 8*rde* along a longitudinal axis 8*r*1 intersecting the upper peripheral edge and the upper central edge; said recess is separate from the first and second upper lateral edges over at least 80% of its length, L8, most remote from the central axis, Z, and
- a pole insert 9 (FIG. 5) having a geometry fitting said recess and being positioned in, and reversibly coupled to said recess.

The term "fitting" means that the pole insert has a general shape able to be precisely inserted into and nested in the recess.

Because of the symmetry requirements of 2*n* for even values of N and of N for odd values of N, discussed supra, the same symmetry must apply to the presence or not of a pole insert on the various hill sectors. Therefore, each hill sector may comprise a similar recess and pole insert.

In prior art cyclotrons comprising pole inserts, the pole inserts were often positioned in a recess machined off a lateral edge of the upper surface of the hill sectors. Access to such pole inserts is, however, rendered difficult by part of the RF accelerating system overlapping the upper lateral edge area. Access to such pole inserts requires removing the overlapping part of the RF system first. Pole inserts were usually located at an edge of the upper surface because it was believed that there, it would least disrupt the overall magnetic field in a hill gap portion.

It was observed that the magnetic field in a hill gap portion could be controlled as efficiently by positioning a pole insert on the upper surface of a hill sector substantially away from the lateral edges, and away from the ground voltage electrode. By thus positioning a pole insert on the upper surface, it may be accessed easily and directly for removal, machining and re-insertion into the recess. For embodiments of the present disclosure, it may thus much easier and efficient to reach the optimal pole insert topography yielding the predicted magnetic field and particle path.

In some embodiments, all pole inserts have the same shape and are made of the same material. In certain aspects, the pole insert is made of the same material as the corresponding hill sector.

When a cyclotron is out of the production line, it is usually tested and the actual properties thus tested are compared with the target properties predicted numerically. The geometry of the pole insert is often then modified according to the results of computer analyses until the actual properties of the cyclotron match the predicted target properties. After each measurement of the properties of the cyclotron, the pole inserts are generally removed from the cyclotron and machined as determined by computer analyses. The machined pole inserts are usually nested into their respective recesses, and the cyclotron is tested again. This process can be repeated in an iterative sequence until the actual properties of the cyclotron are as desired.

Figure 6:
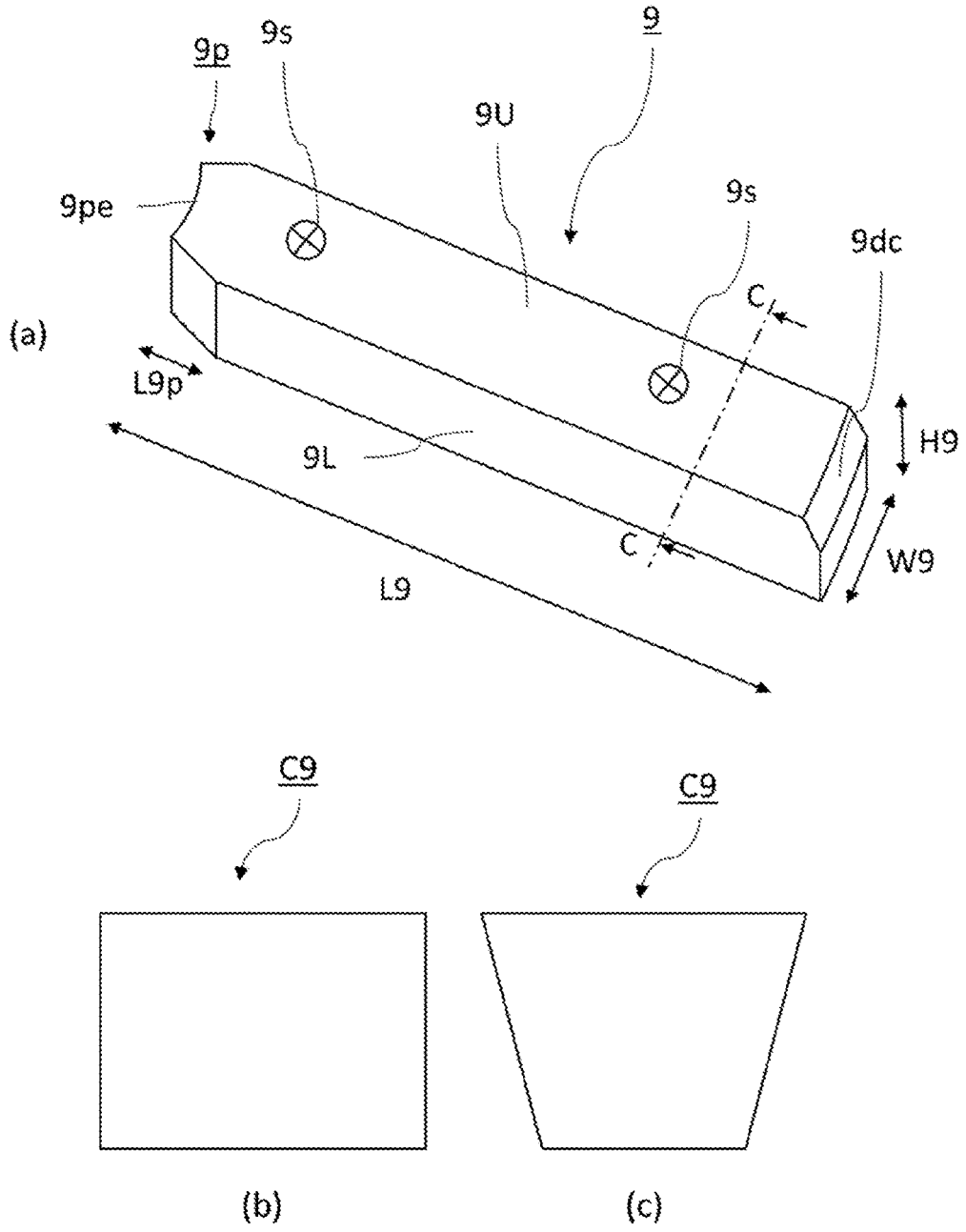
FIG. 6 shows an example of a pole insert before machining (a) and the corresponding cross section (b), (c).

In some embodiments, the recess extends along a longitudinal axis intersecting the central axis. The proximal end of the recess may extend to and open at the upper central edge and/or the distal end of the recess can extend to and open at the upper peripheral edge. As shown if FIG. 4, the recess may be open ended at both ends and extends from the upper central edge all the way to the upper peripheral edge. In certain aspects, the longitudinal axis intersects the upper peripheral edge at a point located at equal distance from the first and second upper distal ends, and wherein the first and second upper distal ends may be symmetrical with respect to the longitudinal axis. For example, except for the proximal portion 9*p* adjacent to the central edge, the pole insert has a general parallelepiped geometry, as illustrated in FIG. 6(*a*).

In the case where the recess is open ended at the upper central edge, the proximal end of the pole insert may comprise the upper central edge. This portion of the hill sector is the narrowest portion of the hill sector, particularly in case the proximal edge is reduced to a single point. The proximal end of the pole insert may thus comprise an upper proximal edge that replaces all or portion of the upper central edge of the hill sector, and a first and second proximal lateral surfaces of not more than 20% of the pole insert length measured along the longitudinal axis, that replaces a small portion of the first and second lateral surfaces of the hill sector. Because the first and second lateral surfaces converge towards the central axis, the first and second proximal lateral surfaces of the pole insert may therefore form a converging portion.

In the case where the recess extends to and is open ended at the upper peripheral edge, the distal end of the pole insert 9*dc* forms a portion of the upper peripheral edge. The portion of the upper peripheral edge formed by the pole insert may be not more than 10%, for example, not more than 5% of the length, Ah, of the upper peripheral edge. This distal end may form a chamfer at the peripheral surface.

Figure 5:
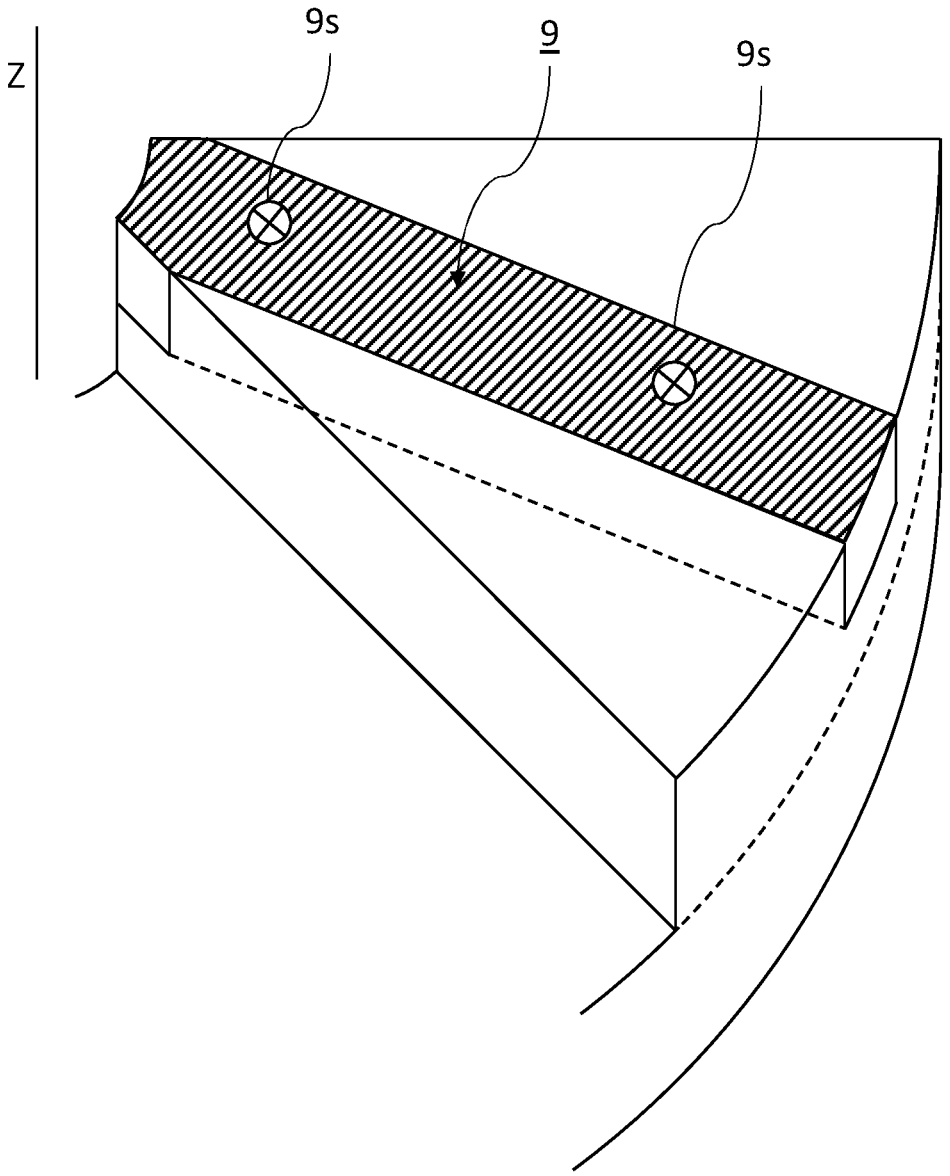
FIG. 5 shows an example of a hill sector according to the present invention comprising a pole insert nested in a recess.

As shown in FIG. 5, the pole insert, 9, is nested in the recess and is reversibly fastened to the corresponding hill sector. For example, it may be coupled to the hill sector with screws 9S.

The pole insert 9 has a length L9 measured parallel to the longitudinal axis, a width W9 measured normal to said longitudinal axis and a height H9 measured normal to both longitudinal axis and width. In certain aspects, the length of the pole insert L9 is equal to the length of the recess L8.

The width W9 of the pole insert may be not more than 15%, for example, not more than 10% or not more than 5% of the length, Ah, of the upper peripheral edge.

The height H9 of the pole insert is measured parallel to the central axis and is less than or equal to the height of a hill sector, Hh, H9≤Hh. For example, the height H9 may be between 20% and 80% of the height of a hill sector, Hh, for example, between 30% and 70% or between 40% and 60% of the height of a hill sector, Hh.

As illustrated in FIGS. 6(*a*) and 7, the pole insert has an insert upper surface 9U. This insert upper surface may be at least partially parallel to the upper surface of the hill sector comprising the recess and, for example, can be at least partially flush with the upper surface. The pole insert also may comprise a first and second insert lateral surfaces 9L, extending transverse form the insert upper surface. Before machining to optimize the properties of the cyclotron, the pole insert may match the geometry of the channel in which it fits snugly, with the insert upper surface being flush with the upper surface of the hill sector. As shown in FIG. 6(*b*), the insert lateral surfaces, as well as the lateral walls of the recess, may be parallel to one another and extend normal to the insert upper surface. In an alternative embodiment, illustrated in FIG. 6(*c*), the first and second insert lateral surfaces are slightly tapered converging from the insert upper surface. With matching tapered lateral walls of the recess, this allows an easier removal and insertion of the pole insert out of and into the recess.

As discussed supra, the pole insert may have a prismatic geometry along the longitudinal axis over at least 80% of its length, L9, excluding the converging proximal portion 9*p*, of length L9*p*. The cross-section C9, normal to the longitudinal axis of the prismatic portion may be trapezoidal with lateral surfaces converging from the upper surface. The proximal portion of the pole insert, forming up to 20% of the length L9, may comprise first and second lateral surfaces converging towards the pole insert proximal edge 9*pe* and being flush and continuous with the hill lateral surfaces 3L. If the ridges between the hill upper surface 3U and the hill lateral surfaces are chamfered, then the corresponding ridges of the proximal portion of the recess may be chamfered too.

For example, if the width, W9, of the prismatic portion of the pole insert is between 15 and 150 mm, the length, L9, of the pole insert may be between 400 and 800 mm, and the height, H9, of the pole insert may be between 15 and 150 mm. The ratio of the length of the pole insert to the length of the proximal portion of the pole insert may be L9*p*/L9≤20%.

During testing of a cyclotron, the upper and/or lateral insert surfaces may be machined to apply thereon a structure with a succession of recesses and protrusions in order to calibrate the magnetic field and thus matching the actual magnetic field to the target field. As discussed above, the optimal geometry of the structures (recesses and protrusions) of the insert surfaces may be determined by an iteration of testing and numerical computations.

Figure 7:
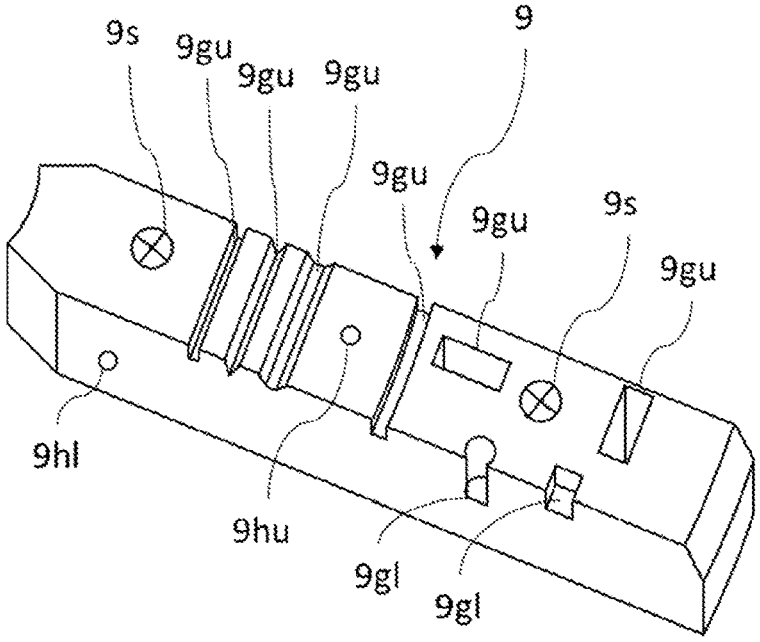
FIG. 7 shows an example of a pole insert after machining

At the end of this iterative process, the topography of the surfaces of the pole inserts may be modified. As illustrated in FIG. 7, the topography of the insert upper surface 9U and/or first and second lateral surfaces 9L may be machined to form grooves 9*gu*, 9*g*1 either transverse, or parallel to the longitudinal axis, of the upper surface or of a lateral surface.

The grooves may extend along a straight, curved or broken line. Alternatively, holes 9*hu*, 9*h*1 can be drilled through the surfaces. The holes can be blind holes (i.e., of finite depth) or can be through holes. As explained supra, if each hill sector comprises a pole insert for symmetry reasons, all pole inserts of a magnet pole must have the same final topography. The pole inserts can be machined individually or aligned side by side and all machined together. The resulting aspect of the machined pole insert may differ considerably from its aspect before machining (cf. FIGS. 6 and 7).

Embodiments of the present disclosure may allow for the pole inserts to be removed and re-inserted much more easily than hitherto possible. It follows that more iterations may be carried out in a given time yielding cost effective cyclotrons performing more closely to their targets than other, known cyclotrons.

Figure 8:
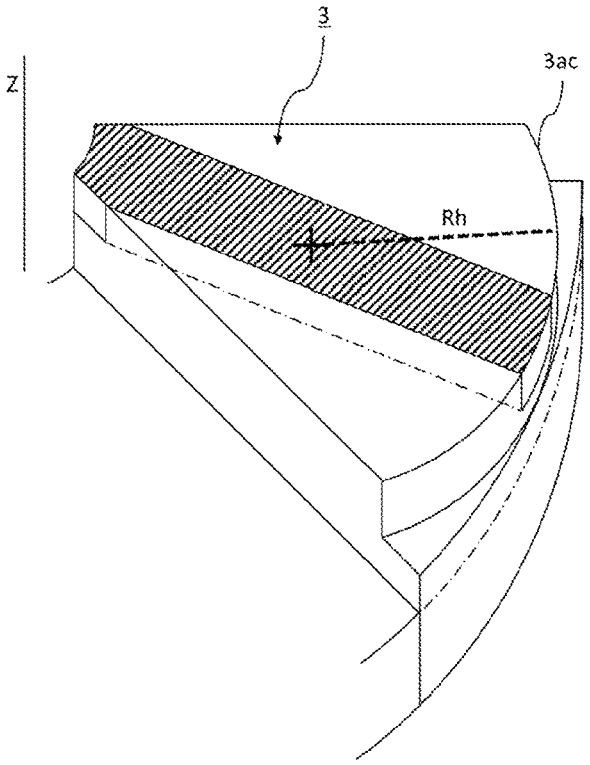
FIG. 8 shows another example of a hill sector according to the present invention comprising an improved upper peripheral edge design of a hill sector.

FIG. 8 shows an example of an embodiment of a magnet pole for a cyclotron according to the present disclosure. In this embodiment, the upper peripheral edge 3*up* is bounded by a first and a second upper distal ends, and the upper peripheral edge of a hill sector comprises an arc of circle 3*ac* which centre is offset with respect to the central axis, and which radius, Rh, is not more than 85% of a distance, Lh, from the central axis to a midpoint of the upper peripheral edge, which is equidistant to the first and second upper distal ends (Rh/Lh≤85%).

In certain aspects, the ratio Rh/Lh of the radius, Rh, to the distance Lh, is not more than 75% (Rh/Lh≤75%), for example, not more than 65% (Rh/Lh≤65%).

Embodiments having the upper peripheral edge comprising an arc of a circle whose centre is offset with respect to the central axis may homothetically approximate at least a portion of the upper peripheral edge to the highest energy (=last) orbit of the spiral path 12 in a hill gap portion 7*h* of the cyclotron. By "homothetically approximate the orbit" is meant that the arc of circle portion of the upper peripheral edge and the last orbit of particle adjacent to the point of extraction are both arcs of circle sharing the same centre with different radii. The arc of the circle may thus be approximately parallel to the portion of said last orbit directly adjacent to and upstream from the extraction point. The length of the path of the extracted orbit and the angle between the orbit and the upper peripheral edge may be independent of the azimuthal position of the extracting system (for example a stripper). In consequence, the characteristics of the extracted beam may be (nearly) independent of the position of the point of extraction.

In certain aspects, the arc of circle extends from the first upper distal end to the second upper distal end of the upper peripheral edge, thus defining the whole peripheral edge of a hill sector and the centre of the arc of circle lies on the bisector of the upper surface, said bisector being defined as the straight line, joining the central axis to the midpoint of the upper peripheral edge.

In certain aspects, the peripheral surface forms a chamfer adjacent to the upper peripheral edge.

As described supra, a cyclotron accelerates the particle beam over a given path until a first point of extraction whence the particle beam can be driven out of the cyclotron with a given energy. A hill sector may comprise more than one point of extraction, for example, two. The arc of the circle portion of the upper peripheral edges of two opposite hill sectors with respect to the median plan MP, of two magnet poles are parallel to and reproduce homothetically a portion of the given path directly upstream of the first point of extraction. The arc of the circle may share the same centre as, and may be parallel to a portion of the given path over the whole peripheral edge. The terms "upstream" and "downstream" are defined with respect to the direction of the particle beam.

When the particle beam has reached its target energy, it may be extracted at a point of extraction and, it may then follow an extraction path downstream of the point of extraction. A part of this extraction path lies between the first and second magnet poles and is thus still comprised within the hill gap portion and subjected to the magnetic field. If the pair of opposite hill sectors comprises a first and a second points of extraction, the particle beam may be extracted either at the first or at the second point of extraction or at both. The particle beam may then follow either a first or a second extraction path downstream of the first or second point of extraction. With the circular geometry of at least a portion of the upper peripheral edge according to the present embodiment, the length of the extraction path comprised within the gap downstream of the first point of extraction, L1, and the length of the extraction path comprised within the gap downstream of the second point of extraction, L2, may be substantially equal.

Embodiments having the same length of extraction paths downstream of the first and second points of extraction may ensure that the particle beam extracted from one point of extraction has similar optical properties as the one extracted from the second point of extraction.

Figure 9:
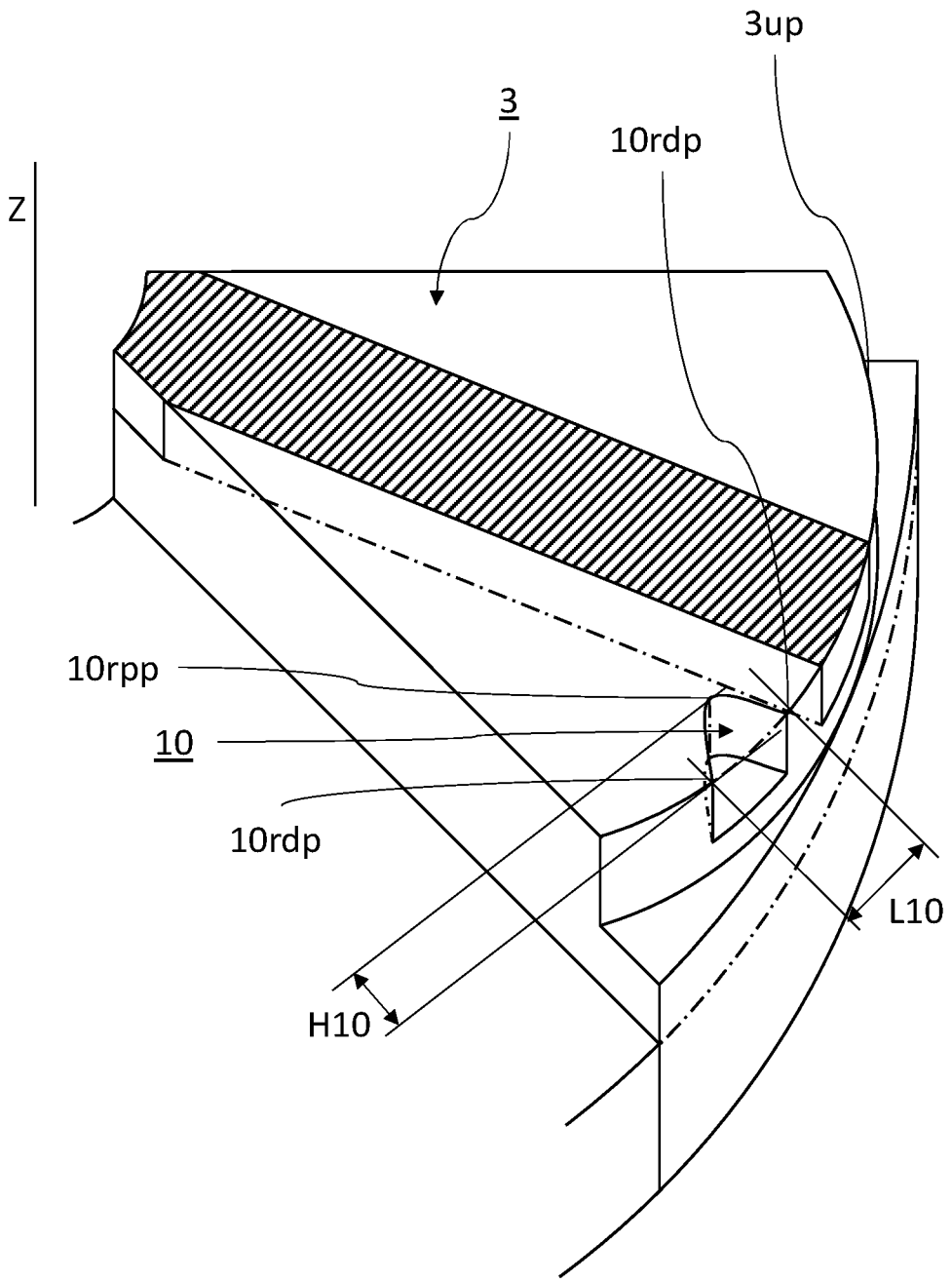
FIG. 9 shows a third example of a hill sector according to example embodiments of the present disclosure further comprising a gradient corrector.

FIG. 9 shows an example of an embodiment of a magnet pole for a cyclotron according to any of the previous embodiments discussed supra. In this example, each hill sector further comprises a first and second lateral surfaces 3L, a peripheral surface 3P such as defined above. The upper peripheral edge 3*up* of the upper surface of at least one hill sector comprises 2 convex portions separated by a concave portion with respect to the central axis defining a recess 10 extending partially over the peripheral surface of the corresponding hill sector.

The term "concave" means curving in or hollowed inward. The concave portion with respect to the central axis of an edge, is a portion of the edge curving towards the central axis. This term is opposed to the term "convex" that means curving out of or extending outward from the central axis.

In some embodiments, the upper peripheral edge 3*up* comprises a first and a second recess distal points 10*rdp*, defining the boundaries of a recess, and which are defined as the points where the tangent of the upper peripheral edge changes sign or presents a discontinuity. The first and second recess distal points may be separated from one another by a distance L10. The recess may also comprise a recess proximal point 10*rpp* defined as the point of the recess located closest to the central axis, Z. The first and second recess distal points 10*rdp* may join the recess proximal point 10*rpp* by a first and second recess converging edges 10*rc*. The recess depth, H10, is defined as the average height of the triangle formed by the first and second recess distal points 10*rdp* and the recess proximal point 10*rpp*, and passing by the recess proximal point 10*rpp*.

In some embodiments, the distance L10 between first and second recess distal points ranges between 5% and 50%, for example, between 10% and 30% or between 15% and 20% of the azimuthal length, Ah, of the upper peripheral edge.

The depth of the recess, H10 may be between 3% and 30%, for example, between 5% and 20% or between 8% and 15% of the azimuthal length, Ah, of the upper peripheral edge.

In some embodiments, the recess also extends parallel to the central axis, Z, over the peripheral surface 3P from the upper peripheral edge 3*up* towards the lower peripheral line 3*lp*. The recess may thus extend over the peripheral surface over a fraction, ζ, of a height of the peripheral surface measured parallel to the central axis between the upper peripheral edge and lower peripheral line. The fraction, may be between 25% and 100%, for example, between 40% and 75% or between 45% and 55%.

In prior art cyclotrons, protruding gradient correctors were often used. Protruding gradient correctors have several drawbacks:

- increase of the volume of the vacuum chamber,
- increase of the volume of the yoke, and of the whole cyclotron,
- increase of the weight of the cyclotron,
- difficulty of precise positioning of the gradient correctors which must be done manually,
- outwards deviation of the magnetic field.

Using recessed gradient correctors instead of protruding gradient correctors may have several advantages. First, it may allow the reduction of the size of the vacuum chamber hosting the magnet poles leading to a decrease of energy required for evacuating the gases from the vacuum chamber and reducing the time of the gas evacuation. Second, the overall weight of the cyclotron may be decreased because, on the one hand, the weight of the hill sectors is slightly reduced instead of being increased and, on the other hand, the overall diameter of the inner surface of flux return yoke is decreased. Third, the position of the recesses may be precisely manufactured and positioned by numerically controlled machining allowing the optimization of the angle at which the particle beam crosses the peripheral edge of the hill sector. Fourth, when protruding gradient correctors deviate the magnetic field outwards, the magnetic field may be deviated inwards by recessed gradient correctors resulting in an inwards shift of the last cycles of the particles path, further away from the peripheral edge of the hill sector, where the magnetic field is more uniform than close to the peripheral edge. It may therefore easier and more predictable to control the properties of the extracted particle beam, and particularly the focusing thereof. This deviation towards the acceleration area may also allow the power fed to the coils to be decreased.

In some embodiments, the recess is generally wedge shaped with the first and second recess converging edges being straight (or slightly curved inwards or outwards) lines. The tip of the wedge corresponds to the recess proximal point and points in the general direction of the central axis. The converging angle, θ, at the tip of the wedge may be between 70° and 130°, for example, between 80° and 110° or 90°±5°. The expressions "inwards" and "outwards" used herein are to be understood as "towards" or "away from" the central axis, respectively.

The position of the recess may either be separated from the first and second lateral edges, or adjacent to the first or second lateral edge. In certain aspects, a hill sector may comprise at least one recess separated from the lateral edges.

More generally, the converging portion of the wedge-shaped recess may have one of the following geometries:

- a sharp corner forming a triangular recess, corresponding to the wedge shaped recess discussed supra;
- a straight edge forming a trapezoidal recessed wedge; or
- a rounded edge wedge.

In some embodiments, a point of extraction may be located within a hill gap portion adjacent to the peripheral edges of a pair of opposed hill sectors. A recess is located downstream from said first point of extraction wherein downstream is defined with respect to the direction of the particle beam. The recess may be precisely machined with respect to the point of extraction and to the extraction path such that the particle beam intersects a first converging recess edge with an angle of 90°±15°, said first converging recess edge being defined as the edge joining the first recess distal points 10*rdp*, to the recess proximal point 10*rpp*. The particle beam may thus leave the hill sector substantially normal to the magnetic field in order to improve the focusing of the exit particle beam. The position and the geometry of the recess may be determined by numerical computation and/or testing.

In conclusion, embodiments of the present disclosure may provide advantages, for example, easy and direct access to the pole insert for removal, machining and re-insertion into the recess. Accordingly, it may be much easier and efficient to reach the optimal insert topography yielding the predicted magnetic field and particle path.

| Ref # | Feature |
|---|---|
| 1 | Cyclotron |
| 2 | Magnet pole |
| 3 | Hill sector |
| 4 | Valley sector |
| 5 | Yokes |
| 6 | Flux return yoke |
| 7 | Gap |
| 8 | Recess |
| 9 | Pole insert |
| 10 | Recess |
| 12 | Spiral path |
| 14 | Coils |
| 3ac | Arc of circle |
| 3ec | Chamfered edge |
| 3L | Lateral surface |
| 3lde | Lower distal end of lower lateral edge |
| 3ll | Lower lateral edge |
| 3lp | Lower peripheral line |
| 3P | Peripheral surface |
| 3U | Upper surface |
| 3uc | Upper central edge |
| 3ude | Upper distal end of upper lateral edge |
| 3ul | Upper lateral edge |
| 3up | Upper peripheral edge |
| 3upe | Upper proximal end of upper lateral edge |
| 4B | Bottom surface |
| 7h | Hill gap portion |
| 7v | Valley gap portion |
| 8lr | Recess longitudinal axis |
| 8rde | Recess distal end |
| 8rpe | Recess proximal end |
| 9C | Pole insert cross-section |
| 9dc | Pole insert distal end chanfered |
| 9gl | Pole insert groove lateral |
| 9gu | Pole insert groove upper |
| 9hl | Pole insert hole lateral |
| 9hu | Pole insert hole upper |
| 9L | Pole insert lateral surface |
| 9lp | Pole insert proximal portion length |
| 9p | Pole insert proximal portion |
| 9pe | Pole insert proximal edge |
| 9s | Pole insert screw |
| 9U | Pole insert upper surface |
| 10rdp | Recess distal point |
| 10rpp | Recess proximal point |
| Ah | Azimuthal length of the upper peripheral edge |
| Gh | Gap height at hill |
| Gv | Gap height at valley |
| H9 | Pole insert height |
| H10 | Recess depth |
| Hh | Hill height |
| L8 | Recess length |
| L9 | Pole insert length |
| L9p | Pole insert length of proximal portion |
| L10 | Recess length between first and second recess distal points |
| Lh | Distance between the central axis and a peripheral edge |

-continued

| Ref # | Feature |
|---|---|
| MP | Median plane |
| PE | Point of extraction |
| Rh | Radius of radial pole contour |
| W9 | Pole insert width |
| Z | Central axis |
| αh | Hill azimuthal angle |
| αv | Valley azimuthal angle |

The invention claimed is:

1. A magnet pole for use in a cyclotron, comprising:

at least three hill sectors, each associated with a magnetic field; and a same number of valley sectors alternatively distributed around a central axis, where each valley sector is associated with a magnetic field, where the magnetic fields of the hill sectors are stronger than the magnetic fields of the valley sectors, each hill sector comprising an upper surface defined by:

an upper peripheral edge, said upper peripheral edge being bounded by a first and a second upper distal ends, and being defined as the edge of the upper surface located furthest from the central axis, an upper central edge, said upper central edge being bounded by a first and a second upper proximal ends and being defined as the edge of the upper surface located closest from the central axis, a first upper lateral edge connecting the first upper distal end and first upper proximal end, and a second upper lateral edge connecting the second upper distal end and second upper proximal end, wherein the upper surface of at least one hill sector further comprises:

a recess extending over a length between a proximal end and a distal end along a longitudinal axis intersecting the upper peripheral edge and the upper central edge, said recess being separate from the first and second upper lateral edges over at least 80% of its length, and a pole insert having a geometry fitting in said recess and being positioned in, and reversibly coupled to, said recess.

2. A magnet pole according to claim 1, wherein the recess extends to the upper peripheral edge.

3. A magnet pole according to claim 1, wherein the recess extends to the upper central edge.

4. A magnet pole according to claim 1, wherein the pole insert includes comprises a portion having a prismatic geometry.

5. A magnet pole according to claim 4, wherein a cross section normal to the longitudinal axis of the prismatic portion of the pole insert is trapezoidal, having lateral surfaces converging from the upper surface.

6. A magnet pole according to claim 4, wherein the pole insert has a proximal portion adjacent to the prismatic portion, wherein an area of a cross-section normal to the longitudinal axis of the proximal portion decreases towards the proximal end of the pole insert, comprises the whole upper central edge, and is flush with the first and second lateral edges of the corresponding hill sector.

7. A magnet pole according to claim 1, wherein the pole insert has a length measured parallel to the longitudinal axis and a width measured normal to said longitudinal axis, and comprises an insert upper surface and a first and second insert lateral surfaces, at least one of the lateral surfaces being structured with a succession of recesses and protrusions.

8. A magnet pole according to claim 7, wherein the recesses and protrusions extend normal to the longitudinal axis over the whole width of the pole insert.

9. A magnet pole according claim 7, wherein at least a portion of the recesses and protrusions are grooves being transverse or parallel to the longitudinal axis and extending along a straight, curved, or broken line.

10. A magnet pole according claim 7, wherein at least a portion of the recesses and protrusions are holes being blind holes or through holes.

11. A magnet pole according to claim 1, wherein each hill sector has an average height measured parallel to the central axis between the upper surface and the valley sector, and wherein the pole insert has a height measured parallel to the central axis and being between 20% and 80% of the height of a hill sector.

12. A magnet pole according claim 11, wherein the pole insert has a height being between 30% and 70% of the height of a hill sector.

13. A magnet pole according claim 12, wherein the pole insert has a height being between 40% and 60% of the height of a hill sector.

14. A magnet pole according to claim 1, wherein each hill sector has an azimuthal length measured between the first and a second upper distal ends, and wherein the pole insert has a width not more than 15% of the azimuthal length of a hill sector.

15. A magnet pole according claim 14, wherein the pole insert has a width not more than 10% of the azimuthal length of a hill sector.

16. A magnet pole according claim 14, wherein the pole insert has a width not more than 5% of the azimuthal length of a hill sector.

17. A magnet pole according to claim 1, wherein each valley sector comprises a bottom surface, and each hill sector comprises first and second lateral surfaces, defined as surfaces extending transversally from the first and second upper lateral edges, to the bottom surfaces of corresponding valley sectors located on either sides of a hill sector, said first and second upper lateral edges preferably forming a chamfer at the level of the first and second lateral edges, respectively.

18. A magnet pole according to claim 1, wherein the first and second lateral edges are straight lines.

19. A magnet pole according to claim 1, wherein the longitudinal axis intersects the upper peripheral edge at a point of the upper peripheral edge located at equal distance ±10% from the first and second upper distal ends.

* * * * *